US006971424B1

(12) United States Patent
Angevine

(10) Patent No.: US 6,971,424 B1
(45) Date of Patent: Dec. 6, 2005

(54) INTERCHANGEABLE HANDBAG

(76) Inventor: Elizabeth Angevine, 24 Landing Rd., Glen Cove, NY (US) 11542

( * ) Notice: Subject to any disclaimer, the term of this patent is extended or adjusted under 35 U.S.C. 154(b) by 164 days.

(21) Appl. No.: 10/615,090

(22) Filed: Jul. 8, 2003

Related U.S. Application Data

(60) Provisional application No. 60/394,628, filed on Jul. 9, 2002.

(51) Int. Cl.[7] ..... A45C 3/06; A45C 3/08; A45C 13/26

(52) U.S. Cl. ..... 150/104; 150/103; 150/107; 150/113

(58) Field of Search ..... 150/103–105, 150/107, 108, 113, 111, 124; D3/233

(56) References Cited

U.S. PATENT DOCUMENTS

| | | | | | |
|---|---|---|---|---|---|
| 811,215 | A | * | 1/1906 | Goldsmith | 150/108 |
| 1,960,396 | A | * | 5/1934 | Rosenberg | 150/105 |
| 2,131,382 | A | * | 9/1938 | Lobel | 150/105 |
| 2,436,237 | A | | 2/1948 | Brandt | 229/87 |
| D154,119 | S | * | 6/1949 | Gumbrill | D3/243 |
| 2,518,572 | A | * | 8/1950 | Sanders | 150/103 |
| 2,522,549 | A | * | 9/1950 | Waggoner | 150/104 |
| D164,621 | S | | 9/1951 | Bienen | |
| 2,573,770 | A | * | 11/1951 | Meadow | 150/107 |
| 2,694,427 | A | * | 11/1954 | Hovis | 150/105 |
| 2,723,696 | A | * | 11/1955 | Kase | 150/105 |
| 3,182,701 | A | * | 5/1965 | Ginsburg | 150/105 |
| 3,451,454 | A | | 6/1969 | Davis | 383/13 |
| 3,575,226 | A | * | 4/1971 | Chapman | 150/104 |
| 4,112,991 | A | | 9/1978 | Barbaresi | 383/13 |
| 4,263,951 | A | | 4/1981 | Siegel | 150/113 |
| 4,811,769 | A | | 3/1989 | Phares | 150/113 |
| 4,907,633 | A | | 3/1990 | Eckstein | 150/105 |
| 5,009,319 | A | | 4/1991 | Jantzen | 150/104 |
| 5,207,254 | A | | 5/1993 | Fromm | 150/104 |
| 5,503,204 | A | | 4/1996 | Byers et al. | 150/105 |
| 5,533,558 | A | * | 7/1996 | Carey et al. | 150/105 |
| 5,725,039 | A | * | 3/1998 | Macinai et al. | 150/104 |
| 6,003,573 | A | | 12/1999 | Owens | |
| 6,179,025 | B1 | * | 1/2001 | Sutton | 150/105 |
| 6,186,201 | B1 | * | 2/2001 | Salz | 150/105 |
| 6,231,233 | B1 | * | 5/2001 | Orce | 383/38 |
| 6,422,278 | B1 | | 7/2002 | Grogan | 150/105 |
| 2002/0029831 | A1 | | 3/2002 | Pendergrass | 150/105 |

FOREIGN PATENT DOCUMENTS

| | | | |
|---|---|---|---|
| WO | WO 93/07777 | * | 4/1993 |

* cited by examiner

*Primary Examiner*—Sue A. Weaver
(74) *Attorney, Agent, or Firm*—Collard & Roe, P.C.

(57) ABSTRACT

A handbag has a frame and an insert. The frame comprises a substantially rigid bottom panel, connected to a front section, a back section and two side sections. Attached to either the front/back sections or the side sections is at least one handle for carrying the bag. There is at least one insert that is removably connected to the frame, to create a complete handbag. The insert is visible through the front and back sections. The insert is connected to the frame via any suitable means, such as velcro, magnetic snaps or any combination of fasteners. The insert has an openable top section to receive the contents of the handbag. Each frame preferably has several different inserts, so that the appearance of the handbag can be changed by simply changing the insert.

10 Claims, 5 Drawing Sheets

INTERCHANGEABLE HANDBAG

CROSS-REFERENCE TO RELATED APPLICATIONS

This application claims priority under 35 U.S.C. §119(e) of U.S. Provisional Application No. 60,394,628, filed on Jul. 9, 2002.

BACKGROUND OF THE INVENTION

1. Field of the Invention

This invention relates to a handbag having an outer frame and interchangeable inserts, so that the appearance of the bag can be changed by changing the insert.

2. The Prior Art

It is often desirable to change the appearance of one's handbag to coordinate with an outfit, shoes, etc. It can be prohibitively expensive to have a different handbag for evert occasion or outfit, so a handbag that can be altered is a more economical solution. One such interchangeable handbag is shown in U.S. Pat. No. 4,112,991 to Barbaresi. This bag shows a rigid, transparent basket-like frame and an interchangeable soft fabric bag inside it. The handles of the handbag are connected through the frame and bag. The bag folds over the top of the frame. The bags can be interchanged to change the look of the handbag.

Another interchangeable handbag is shown in U.S. Pat. No. Des. 164621 to Bienen. This patent shows an inner handbag with an interchangeable cover. U.S. Pat. No. 6,003,573 to Owens shows an interchangeable purse assembly in which a soft inner liner can be used with one of several different outer handbag components. U.S. Pat. No. 6,422,278 to Grogan shows a pair of nested handbags that can also function as independent units. U.S. Pat. No. 4,811,769 to Phares discloses a purse insert that can be transferred from one purse to another. U.S. Pat. No. 4,907,633 to Eckstein discloses a handbag assembly in which a variety of outer decorative coverings can be attached to the main bag.

Other handbag arrangements are also shown in U.S. Pat. Nos. 5,207,254 to Fromm, 5,503,204 to Byers et al., 3,451,454 to Davis, 2,436,237 to Brandt, 5,009,319 to Jantzen and 4,263,951 to Siegel, as well as in U.S. Patent Application No. US2002/0029831A1 to Pendergrass.

SUMMARY OF THE INVENTION

It is an object of the invention to provide a handbag that has an easily interchangeable component to change the appearance of the handbag.

It is another object of the invention to provide a handbag that is aesthetically pleasing and made of high quality materials.

These and other objects are accomplished by a handbag having a frame and an insert. The frame comprises a substantially rigid bottom panel, connected to a front section, a back section and two side sections. The front and back sections are preferably substantially U-shaped leaving an open area through the front and back. The side sections are preferably solid and extend up the entire height of the handbag. Attached to either the front/back sections or the side sections is at least one handle for carrying the bag.

There is at least one insert that is removably connected to the frame, to create a complete handbag. The insert is visible through the front and back sections, which have an open U-shape. The insert is connected to the frame via any suitable means, such as velcro, magnetic snaps or any combination of fasteners. The insert has an openable top section to receive the contents of the handbag. The insert is preferably closeable via any suitable means, such as a zipper, a flap with a buckle, a magnetic snap, velcro, etc.

The frame is preferably constructed of high quality leather, but other materials could also be used. Because the frame forms a substantial part of the exterior of the handbag, and is very visible, it is important that the frame be constructed of an attractive yet durable material. The insert can be constructed of any suitable material, such as leather, suede, canvas, silk, cotton, etc. Preferably, the owner of the handbag has several different inserts that are usable with the single frame. The inserts can be made of softer material than the frame, because it is the frame that contains the bottom and handles of the handbag. The bottom and handles are the most subject to wear and dirt. Thus, the handbag according to the invention combines the durability and functionality of a sturdy frame with the beauty of a variety of inserts, which can be made of more delicate materials.

In another embodiment of the invention, the frame is constructed of a bottom panel, a front and back section that each comprise a low horizontal bottom panel and two vertical straps, and a side section that is higher than the front and back sections, and which wraps around to the front and back sections. The two vertical straps are connected via a buckle to the handles of the handbag. The insert is similar to the insert described above, but has two loops located near the top on each of the front and back sides of the insert. The handles of the handbag are threaded through these loops before being buckled to the two vertical straps. The loops thus keep the frame and insert firmly in place with respect to each other. The frame and insert are also preferably connected to each other on their respective bottom sections via a hook and loop type fastener such as Velcro® and/or magnetic snaps. Other types of fasteners could also be used. As with the first embodiment, the frame is preferably constructed of a durable material that can hold its shape, and the inserts can be constructed of any type of leather, suede, fabric, or synthetic material.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
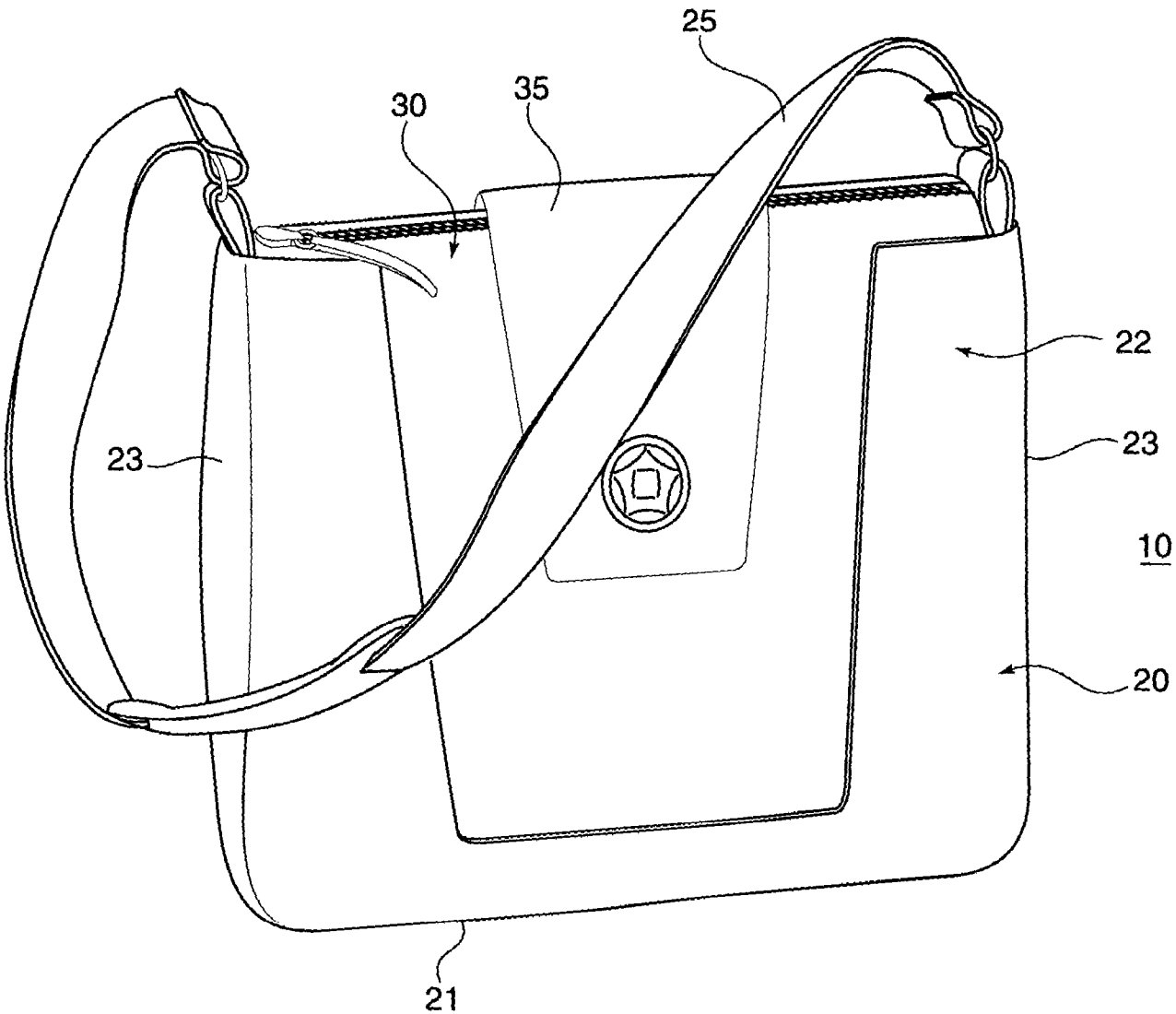
FIG. 1 shows a front view of a preferred embodiment of the handbag according to the invention.
Figure 3:
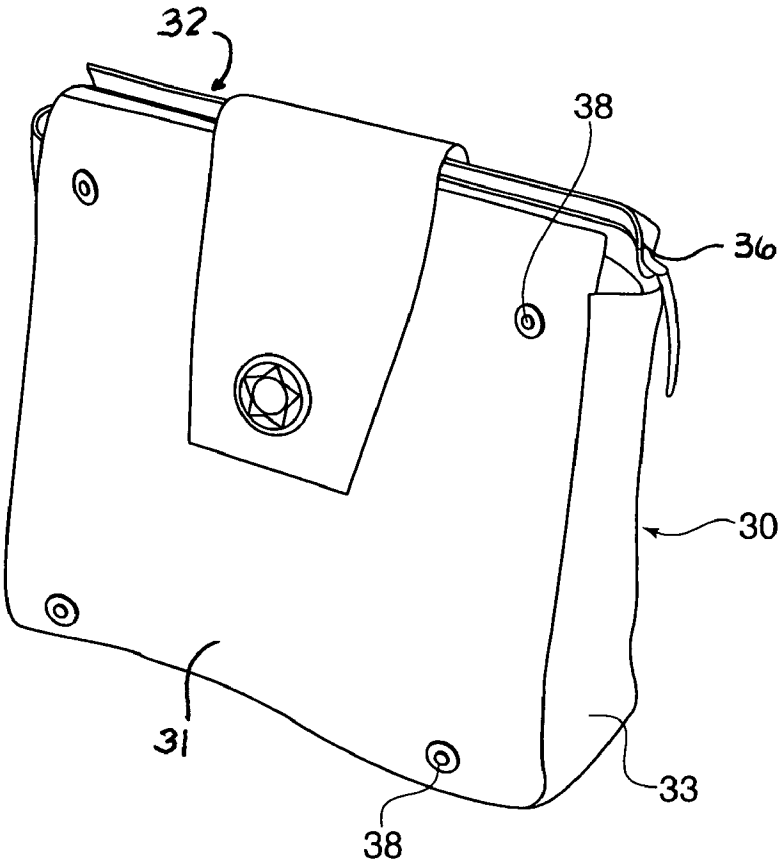
FIG. 3 shows a front view of an insert according to FIG. 1.
Figure 2:
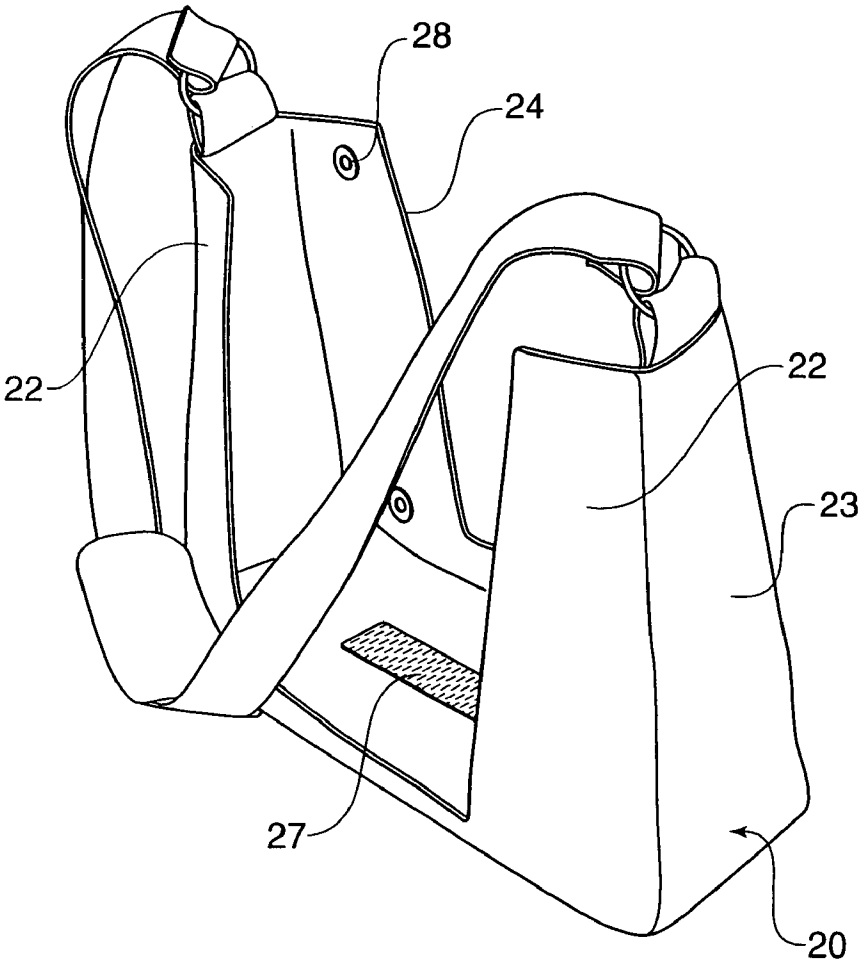
FIG. 2 shows a front view of the frame according to FIG. 1.

Referring now in detail to the drawings, FIGS. 1–4 show a first embodiment of the handbag 10 according to the invention. Handbag 10 comprises a frame 20 and an insert 30. Frame 20 consists of a bottom panel 21, a front section 22, a rear section 24 (shown in FIG. 2) and two side sections 23. Front section 22 rear section 24 each have a rectangular cutout on their faces. Side sections 23 are solid and extend the full height of handbag 10. A handle 25 is connected to side sections 23. Alternatively, handle 25 could also be connected to front and rear sections 22, 24.

Figure 4:
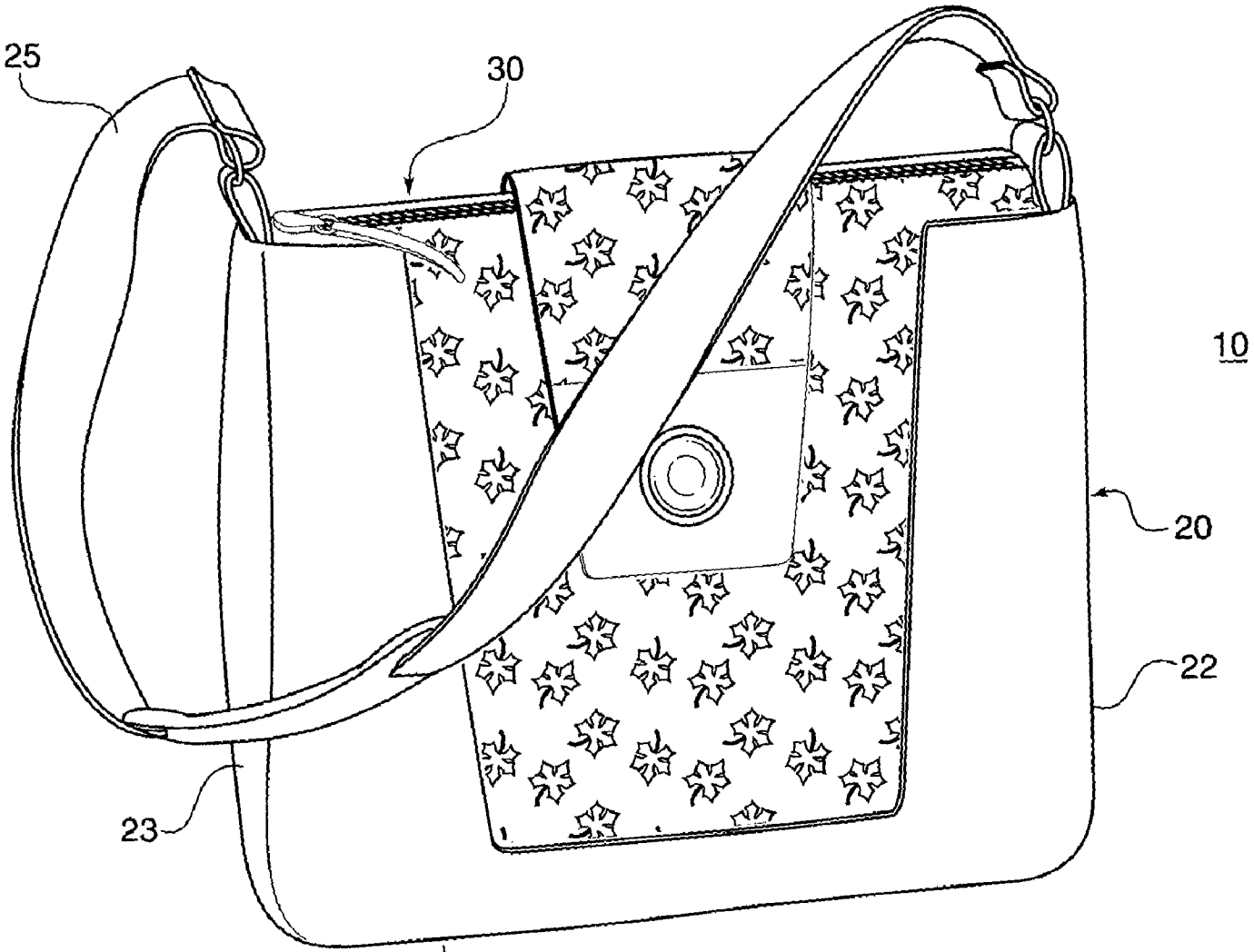
FIG. 4 shows a front view of the frame of FIG. 2 having a different insert.
Figure 5:
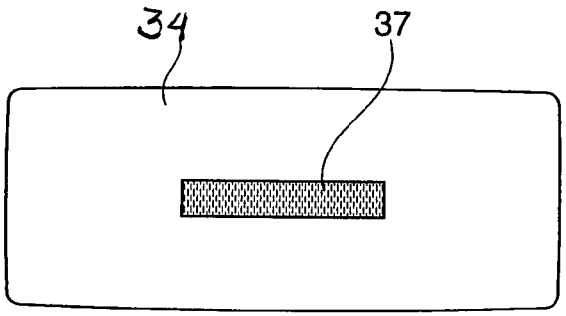
FIG. 5 shows a bottom view of the insert of FIG. 2.

Insert 30 comprises a front section 31, a rear section 32, two side sections 33 and a bottom panel 34. Insert 30 is closeable at its top via a flap 35 and a zipper 36. Other methods for closing the top of insert 30 could also be used. Insert 30 is inserted within frame 20 and is releasably connected to frame 30 via a hook and loop-type fastener 27, 37, mounted on each of the bottom panels of frame 20 and insert 30 (See FIGS. 1 and 5, respectively). In addition, magnetic snaps 28, 38 also secure insert 30 to frame 20. When insert 30 is secured to frame 20, insert 30 is fully visible through the cutout in the front and back sections 23, 24 of frame 24. Changing insert 30 changes the appearance of handbag 10. Frame 20 could also have a cutout of a different shape, such as a semicircle. Preferably, a user has several inserts 30 for each frame 20, so that the appearance of handbag 10 is easily altered, as shown by FIG. 4, which has a different insert 30 than the one shown in FIG. 1.

Preferably, frame 20 is made of a stiff material such as reinforced leather, so that it can hold its shape over time. Insert 30 can be made of any material, such as leather, suede or any type of fabric.

Figure 7:
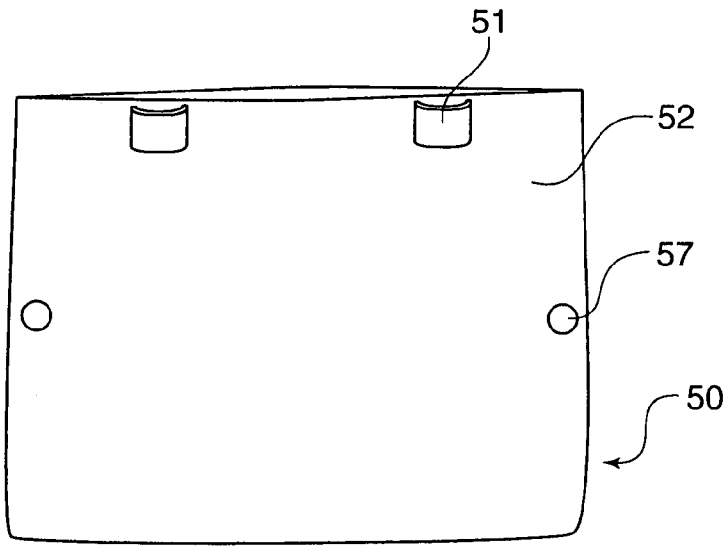
FIG. 7 shows an alternative insert to be used with the alternative frame of FIG. 6.
Figure 6:
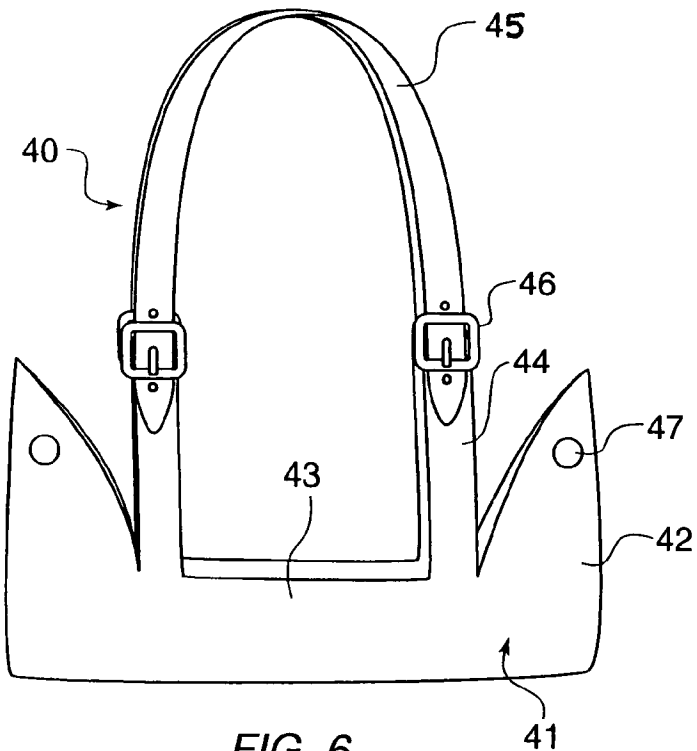
FIG. 6 shows an alternative frame according to the invention.
Figure 8:
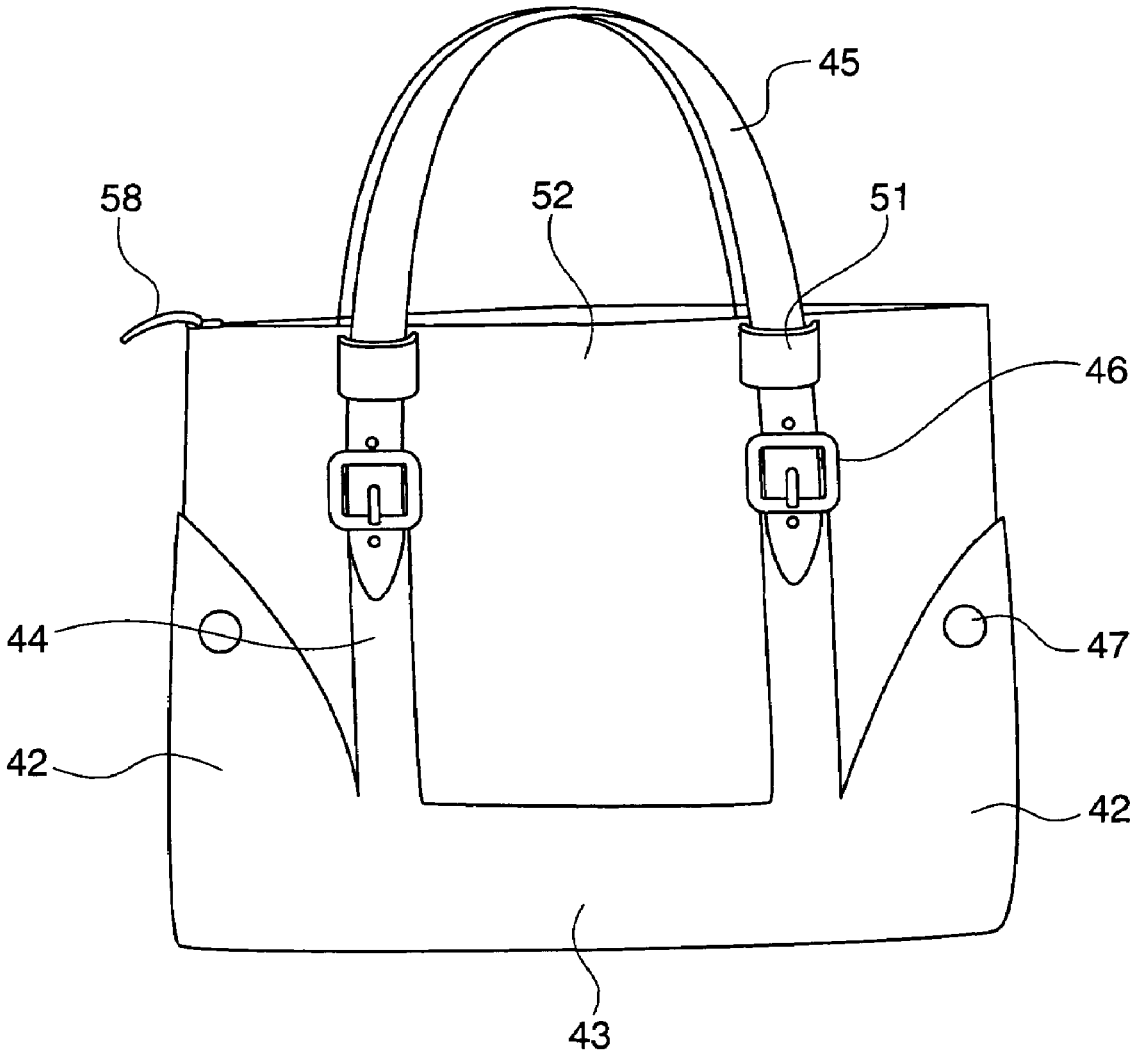
FIG. 8 shows the complete handbag comprised of the insert of FIG. 7 inserted into the frame of FIG. 6.

FIGS. 6–8 show an alternative embodiment of the handbag 10 according to the invention. In this embodiment, frame 40 comprises a front section 41, a rear section (not shown) and side sections 42. Front section 41 consists of a bottom strip 43 and two vertical straps 44, which are connected to handles 45 via a buckle 46. Side sections 42 consist of tapered sides that slope down to connect with bottom strip 43.

Insert 50 has two loops 51 attached to its front surface 52. There are also two loops connected to the back surface (not shown). Loops 51 are preferably made of a stiff durable material. Insert 50 is closeable via a zipper 58 (shown in FIG. 8). Other closures could also be used. Insert 50 is inserted into frame 40 and is secured there via magnetic snaps 47, 57. Hook and loop-type fasteners can also be used.

As shown in FIG. 8, when insert 50 is inserted into frame 40, handles 45 are threaded underneath loops 51 to keep insert 50 secure within frame 40.

Accordingly, while only a few embodiments of the present invention have been shown and described, it is obvious that many changes and modifications may be made thereunto without departing from the spirit and scope of the invention.

What is claimed is:

1. A handbag comprising:

a frame comprising:

(a) a bottom panel;

(b) a front section connected to the bottom panel, said front section having at least one open area;

(c) a back section connected to the bottom panel, said back section having at least one open area;

(d) two side sections, each connected to the bottom panel and to the front and back sections; and (e) two handles connected to the frame for carrying the handbag; and at least one insert comprising:

(a) a bottom panel; and (b) at least two side walls that are connected to the bottom panel and have closed sides, such as to create a compartment with a top opening, wherein said top opening is closeable, wherein said insert has a length, width and height that is similar to the length, width and height of the frame, such that the insert fits snugly within the frame, and wherein a portion of the insert is connectable to a portion of the frame to keep the insert within the frame during use; and wherein the front and back sections consist of narrow bands that extend along a bottom side of the front and back sections, and two vertical straps that extend up from the narrow bands, said vertical straps connecting with the handles of the handbag, and wherein the straps are connected to the handles via buckles.

2. The handbag according to claim 1 wherein the open areas of the front and back sections are rectangular cutouts.

3. The handbag according to claim 1, wherein the frame is constructed of a stiff material that retains its shape.

4. The handbag according to claim 3, wherein the material is reinforced leather.

5. The handbag according to claim 1, wherein the insert is formed of a different material than the frame.

6. The handbag according to claim 5, wherein the material is selected from the group consisting of leather, suede, plastic, silk, canvas, velvet, or other natural or synthetic fabrics.

7. The handbag according to claim 1, wherein the side sections extend only partially up the height of the handbag.

8. The handbag according to claim 1, wherein the insert is closeable via a flap that covers the openable top of the insert.

9. A handbag comprising:

a frame comprising:

(a) a bottom panel;

(b) a front section connected to the bottom panel, said front section having at least one open area;

(c) a back section connected to the bottom panel, said back section having at least one open area;

(d) two side sections, each connected to the bottom panel and to the front and back sections; and (e) two handles connected to the frame for carrying the handbag; and at least one insert comprising:

(a) a bottom panel; and (b) at least two side walls that are connected to the bottom panel and have closed sides, such as to create a compartment with a top opening, wherein said top opening is closeable, wherein said insert has a length, width and height that is similar to the length, width and height of the frame, such that the insert fits snugly within the frame, and wherein a portion of the insert is connectable to a portion of the frame to keep the insert within the frame during use; and wherein the front and back sections consist of narrow bands that extend along a bottom side of the front and back sections, and two vertical straps that extend up from the narrow bands, said vertical straps connecting with the handles of the handbag, wherein the insert has two loops on each of the side walls, such that when the insert is placed within the frame, the handles are threaded through the loops before being connected to the straps, so that the insert is securely connected to the frame.

10. The handbag according to claim 9, wherein the loops are located along a top edge of the insert.

* * * * *